United States Patent [19]

Isomura et al.

[11] 4,441,473

[45] Apr. 10, 1984

[54] CLOSED LOOP MIXTURE CONTROL USING LEARNING DATA RESETTABLE FOR FUEL EVAPORATION COMPENSATION

[75] Inventors: Shigenori Isomura; Katsuhiko Kodama, both of Kariya; Toshio Kondo, Anjyo; Akio Kobayashi, Kariya, all of Japan

[73] Assignee: Nippondenso Co., Ltd., Kariya, Japan

[21] Appl. No.: 243,514

[22] Filed: Mar. 13, 1981

[30] Foreign Application Priority Data

Mar. 28, 1980 [JP] Japan ..... 55-40866

[51] Int. Cl.[3] ..... F02M 17/00

[52] U.S. Cl. ..... 123/440; 123/489

[58] Field of Search ..... 123/440, 489

[56] References Cited

U.S. PATENT DOCUMENTS 4,130,095 12/1978 Bowler et al. ..... 123/440

4,235,204 11/1980 Rice ..... 123/440

*Primary Examiner*—Tony M. Argenbright

*Attorney, Agent, or Firm*—Cushman, Darby & Cushman

[57] ABSTRACT

A closed loop mixture control system for internal combustion engines is responsive to a signal derived from an exhaust gas sensor. The sensor signal is time-integrated in a direction depending on the level of the gas sensor output to derive a first mixture corrective setting of the control system. Second corrective settings or learning data are established for the control system in correspondence with the amount of air supplied to the engine. Each of the latter settings is varied as a function of time in a direction depending on the value of the time-varying first corrective setting relative to a reference so that the second settings are automatically updated to meet varying engine performance such as aging. One of the second corrective settings is selected in response to the detected quantity of the supplied air and multiplied by the first corrective setting to correct the basic mixture control setting of the system toward an optimum value. All of the second corrective settings are reset to appropriate values, for example, "1" at the instant the engine is started if an average value of the second settings is greater than a predetermined value to compensate for different fuel vaporizations.

16 Claims, 9 Drawing Figures

| IDLE Sw \ Q | 1 | 2 | 3 | --- | --- | n-1 | n | n+1 | --- | --- | 30 | 31 |
|---|---|---|---|---|---|---|---|---|---|---|---|---|
| ON | $K_1^1$ | $K_2^1$ | $K_3^1$ | --- | --- | $K_{n-1}^1$ | $K_n^1$ | $K_{n+1}^1$ | --- | --- | $K_{30}^1$ | $K_{31}^1$ |
| OFF | $K_1^2$ | $K_2^2$ | $K_3^2$ | --- | --- | $K_{n-1}^2$ | $K_n^2$ | $K_{n+1}^2$ | --- | --- | $K_{30}^2$ | $K_{31}^2$ |

CORRECTION VALUE K2
INCREASE
DECREASE
1.0
a
b
OVER ENRICHED
1.2.3----------30.31
ADDRESS DATA REPRESENTING INTAKE AIRFLOW WHEN THROTTLE IS CLOSED
ADDRESS DATA REPRESENTING INTAKE AIRFLOW WHEN THROTTLE IS OPEN

CLOSED LOOP MIXTURE CONTROL USING LEARNING DATA RESETTABLE FOR FUEL EVAPORATION COMPENSATION

BACKGROUND OF THE INVENTION

The present invention relates to a method and system for controlling the mixture of air and fuel supplied to internal combustion engines at a variable ratio in response to a signal derived from an exhaust gas sensor to reduce the emission of the noxious components of burnt gases.

In conventional closed loop mixture control systems, the signal derived from the exhaust gas sensor is integrated to control the mixture ratio with a time integrated gas sensor signal. The time integration provides an averaging effect on the controlled mixture ratio and serves to minimize the amount of deviation of the controlled ratio over a period of time from the desired stoichiometric point at which the harmful emissions are converted into harmless products at a maximum efficiency. However, a common problem associated with the time integrated mixture control is that the system fails to respond quickly to manual command for acceleration or deceleration. Another problem associated with the closed loop control is that the exhaust gas sensor is inactive for startup periods because of low sensor environment temperatures.

SUMMARY OF THE INVENTION

The closed loop control system for supplying air and fuel to internal combustion engines at a variable ratio comprises an exhaust gas sensor located in the engine exhaust system to generate a signal which represents the concentration of noxious components of the exhaust gases in binary levels. The gas sensor signal is time integrated to derive a first mixture correction data. According to the invention, a set of second mixture correction learning data is stored in memory locations corresponding to different engine loads. An intake air flow sensor is provided to detect the amount of power which the engine delivers. The second correction datum that corresponds to the detected air flow is constantly varied in a direction depending on the value of the first correction datum relative to a reference value. The second correction datum, thus automatically updated in conformance with varying engine operating performance such as aging, is selected from the memory in response to the detected air flow and multiplied by the first correction datum. The air-fuel ratio is controlled in response to the multiplied value of the first and second correction data. Since one of the previously learned or updated second correction data is selected in correspondence with the air flow, the air-fuel ratio is varied rapidly in response to a manual command applied to the engine.

The operating state of the exhaust gas sensor is also detected to determine whether the system is appropriate for closed loop or open loop operation. When the gas sensor environment temperature is considerably low, the sensor's inactive state is detected and the first correction datum is reset to the above-mentioned reference value. The second correction data are reset to appropriate initial values at the instant the engine is started and the initial values are maintained as long as the first correction datum remains at the reference value to control the air-fuel ratio in the open loop mode. This prevents the air-fuel ratio from considerably deviating from the desired point which would otherwise occur if the system is allowed to respond to false gas sensor signals.

Since the amount of fuel vapor in the fuel tank tends to differ depending on different engine operations, it is advantageous to alter the second correction data by an amount corresponding to the difference in the amount of fuel vapor whenever the engine is started.

BRIEF DESCRIPTION OF THE DRAWINGS

The invention will be further described by way of example with reference to the accompanying drawings, in which.

DETAILED DESCRIPTION

Figure 1:
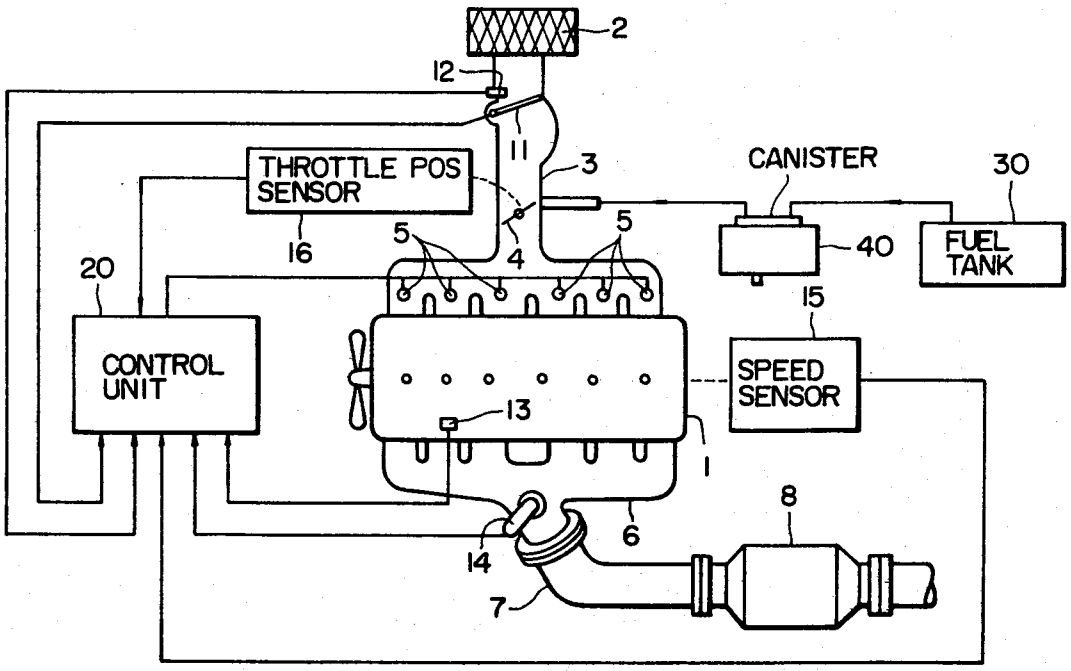
FIG. 1 is an illustration of a schematic diagram of the mixture control system of the invention.

Referring now to FIG. 1, a four cycle spark ignition engine 1 takes in filtered air through an air cleaner 2 and an air intake pipe 3 in which is provided a throttle valve 4. Electromagnetic fuel injection valves 5 are provided to supply fuel from a fuel tank 30 via a canister 40 to the cylinders of the engine in response to fuel injection pulses provided by a control unit 20. Burnt gases are exhausted through an exhaust manifold 6 and exhaust pipe 7 in which a three-way catalytic converter 8 is located to convert the harmful emissions into harmless products. An air flow sensor 11 and an intake air temperature sensor 12 are provided in the intake passage 3 to supply the control unit 20 with sensed engine operating parameters. An engine coolant temperature sensor 13 is also fitted to the engine block. An oxygen sensor 14 is provided in the exhaust manifold 6 to detect the concentration of residual oxygen in the exhaust gases. The sensor 14 generates a high voltage signal, typically 1 volt, when the air-fuel mixture ratio is richer than stoichiometric and a low voltage signal, typically 0.1 volts, when the air-fuel ratio is leaner than stoichiometric. The speed of the engine 1 is represented by the frequency of a pulse signal derived from a speed sensor 15 connected to the engine crankshaft. The ignition coil, not shown, may serve to function as the engine speed detector. A throttle position detector 16 is provided to detect when the engine 1 is idling or when the throttle valve is substantially closed. The control unit 20 receives engine operating parameters from the sensors 11 to 16 to process the input signals to determine the optimum fuel injection time for each fuel injection valve.

Figure 2:
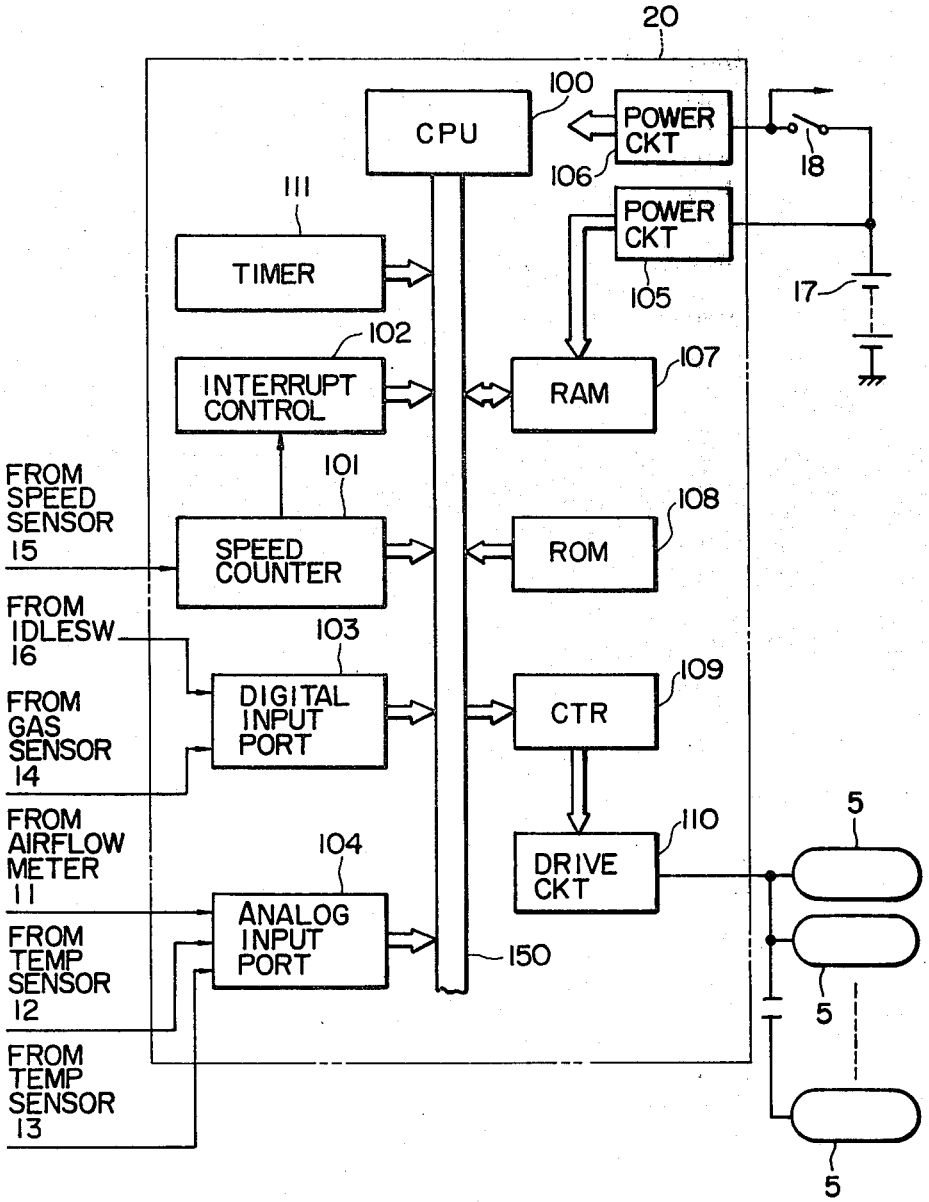
FIG. 2 is an illustration of a block diagram of the control unit of FIG. 1.

FIG. 2 is an illustration of the control unit 20 which generally comprises a microcomputer including a central processing unit (CPU) 100. An engine speed counter 101 takes its input from the engine speed sensor 15 to provide the CPU 100 with a binary representation of engine speed value and to give a command signal to an interrupt control unit 102 in synchronism with each engine crankshaft revolution in order to cause the CPU to interrupt its main routine tasks to update air-fuel ratio correction data which will be described later. Digital signals from the oxygen sensor 14 and throttle position detector 16 are coupled to a digital input port 13 and analog signals from the sensors 11, 12 and 13 are fed into an analog input port 104 where the input signals are converted into corresponding digital signals by analog-digital converters. A random access memory (RAM) 107 is powered at all times from power supply circuit 105 connected directly to a DC voltage source 17. The voltage source 17 is also connected to another power circuit 106 through an ignition key switch 18. The power circuit 106 supplies currents to various sections of the microcomputer except for the RAM 107. The RAM 107 thus operates as a non-volatile memory so that its stored contents are not erased even if the switch 18 is turned off. Magnetic bubble memory could equally be used to advantage as the ROM 108 since it can eliminates use of a backup battery. A read only memory (ROM) 108 stores therein program data and various constant data. A down counter 109 receives valve open time digital data from the CPU 100 and converts it into an activating pulse for each fuel injection valve through a drive circuit 110. A timer circuit 111 detects the elapse of time which is supplied to the CPU 100. The CPU 100 receives all of its input data through a common bus 150.

Figure 3:
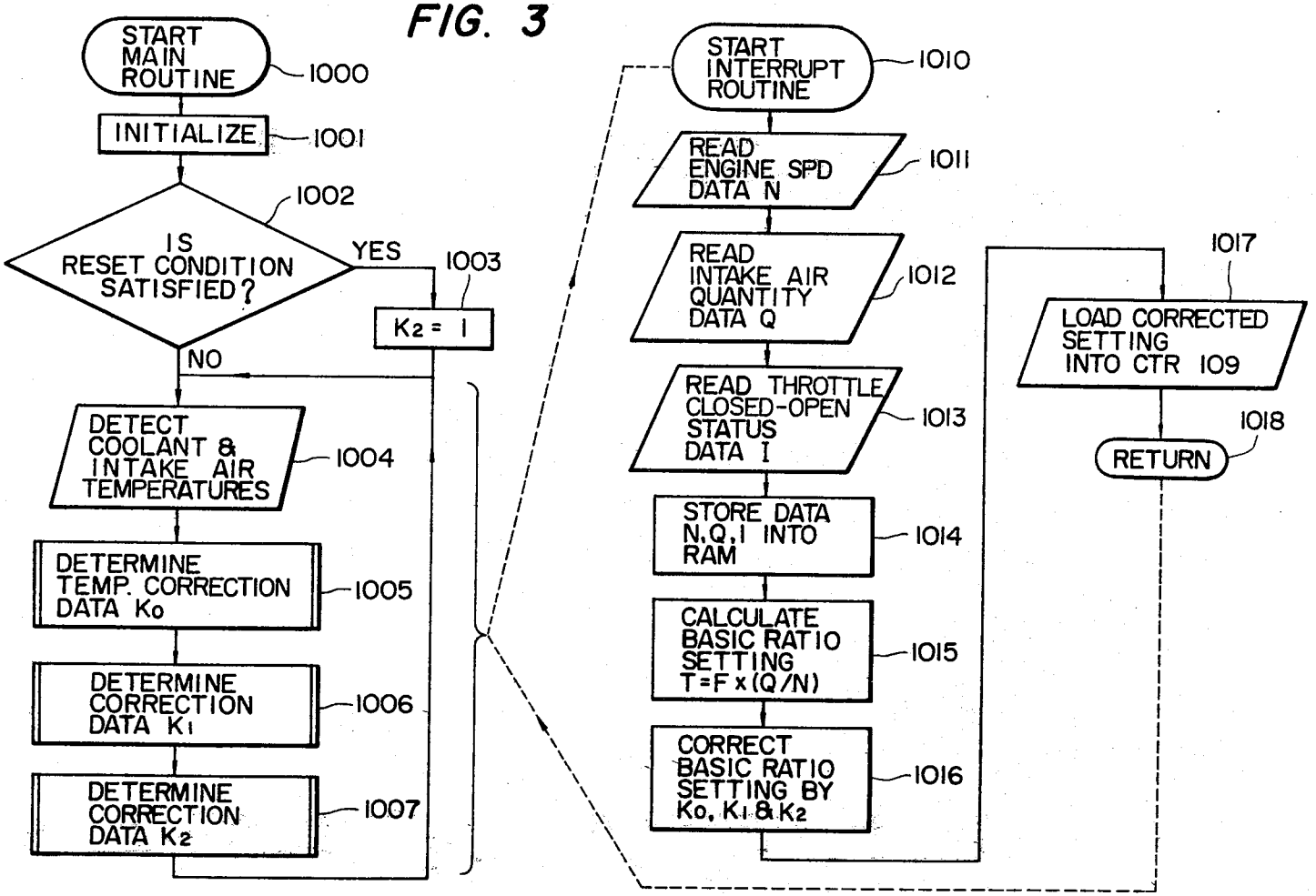
FIG. 3 is an illustration of a flowchart describing a general outline of the program steps of the microcomputer of FIG. 2.

FIG. 3 is an illustration of a flowchart which describes the general outline of the functions performed by the CPU 100. When the engine 1 starts operating in response to the ignition key switch 18 being turned on. The program starts off with a step 1000 and various data are initialized in a step 1001. At step 1002, the CPU 100 determines whether second correction data $K_2$ (which will be described in detail later) which have been stored in memory in a previous engine operation is greater than specified values, and if so, the stored $K_2$ values are reset to preselected values at step 1003.

In a step 1004 the CPU 100 reads in coolant and air temperature data from the analog input port 104. At step 1005, these data are used to retrieve temperature correction datum $K_0$ from a set of correction data stored in advance in the ROM 108, the retrieved correction datum $K_0$ being stored in a specified location of the ROM 107 for later use when the fuel injection time is calculated. At step 1006, the CPU reads in the output signal from the exhaust gas sensor 14 through the digital input port 103 and updates a first air-fuel ratio correction datum $K_1$ which represents a time integral of the output of the exhaust gas sensor 14, the first correction datum $K_1$ being stored in a specified cell of the RAM 107.

Figure 4:
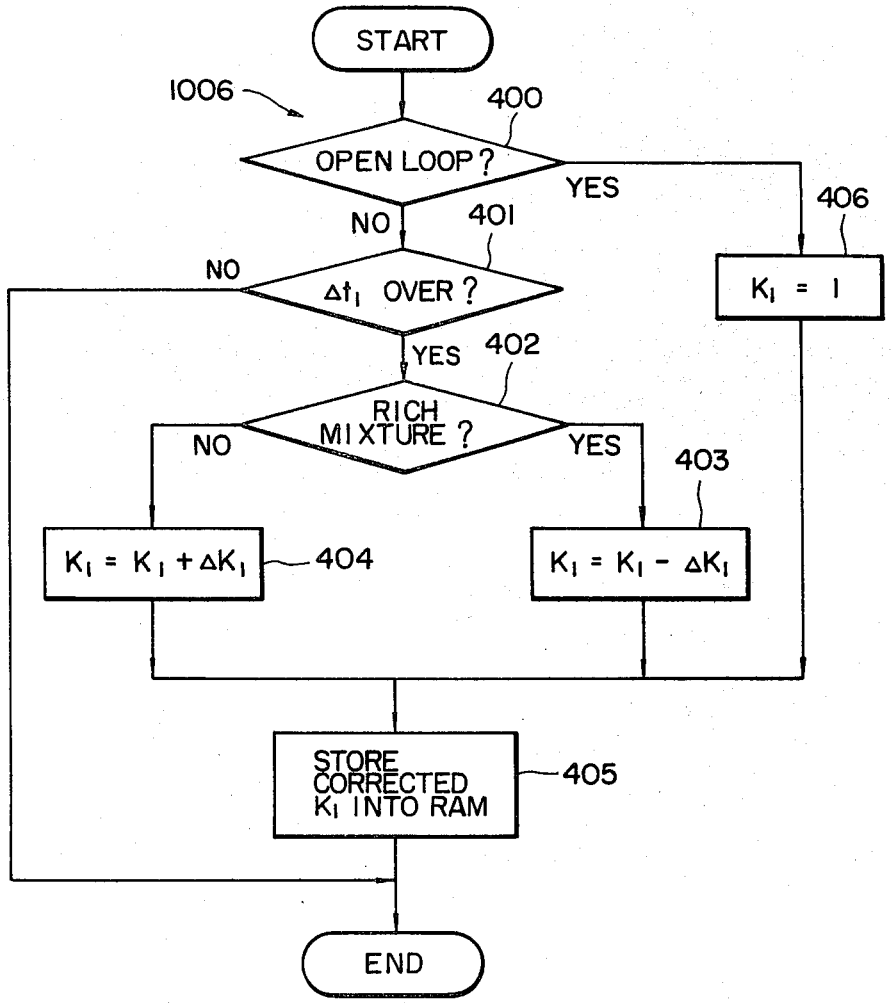
FIG. 4 is an illustration of the detail of a step of FIG. 3 in which the first correction datum is derived.

The detail of the step 1006 is illustrated in FIG. 4. At step 400, the CPU 100 checks to see if the exhaust gas sensor 14 is functioning properly at the normal operating temperature or checks to see if the coolant temperature of the engine warrants closed loop mixture control operation. If the CPU 100 determines that the system is not conditioned to operate in the closed loop mode, it proceeds to a step 406 to set the first correction datum $K_1$ to "1", and then proceeds to a step 405 to store the correction datum $K_1$ in the RAM 107. If the CPU 100 determines that the system is conditioned for closed loop operation, a step 401 is executed to determine whether a time $\Delta t_1$ has elapsed from the previous cycle. If the time period $\Delta t_1$ has not elapsed, the correction datum $K_1$ remains unaltered and if this period has elapsed, the CPU goes to a step 402 to determine whether the output of the exhaust gas sensor 14 indicates a rich or lean mixture condition. If a rich condition is detected, a decrement $\Delta K_1$ is subtracted from the $K_1$ value obtained in the previous cycle at step 403. If a lean condition is detected, an increment $\Delta K_1$ is added to the $K_1$ value at step 404. The updated $K_1$ value is stored in the RAM 107 at step 405. In this way, the correction datum $K_1$ is varied as a function of time in a direction depending on the output of the exhaust gas sensor 14 as the step 1006 is repeatedly executed.

Figure 5:
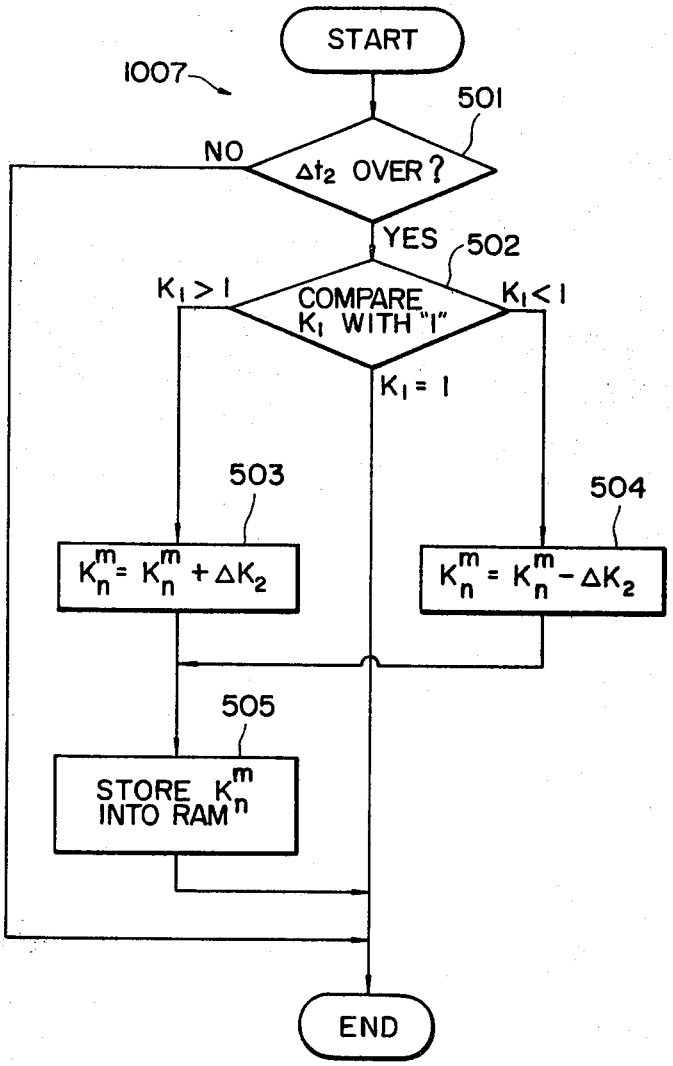
FIG. 5 is an illustration of the detail of a step of FIG. 3 in which the second correction data are derived.
Figures 6, 7:
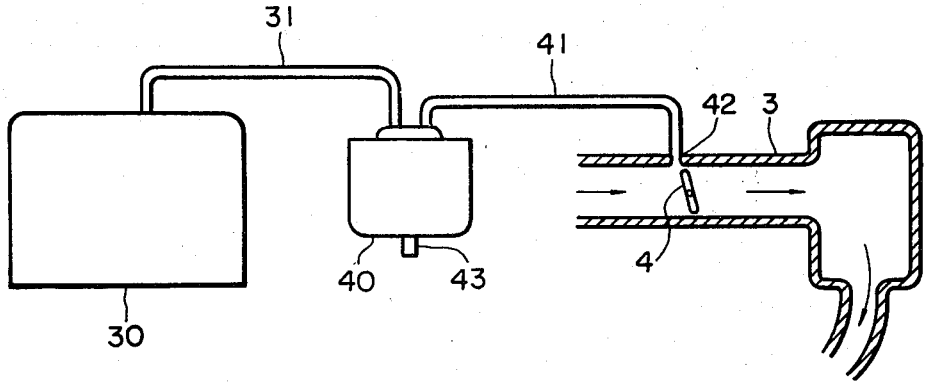
FIG. 6 is an illustration of a map in which the second correction data are stored.
FIG. 7 is an illustration of the fuel supply system of the international combustiin engine of FIG. 1.

Following the execution of step 1006, a step 1007 is executed to update one of the second air-fuel ratio correction data $K_2$. The detail of the step 1007 is illustrated in FIG. 5. At step 501, the CPU 100 determines whether a time $\Delta t_2$ has elapsed from the previous cycle and if not, the $K_2$ data remain unchanged. If the time $\Delta t_2$ has elapsed, the CPU goes to a step 502 to determine whether the first correction datum $K_1$ is equal to or smaller or greater than "1". If $K_1=1$ is detected, the second correction data $K_2$ are not updated. If $K_1$ is detected, a step 503 is executed to increase one of the $K_2$ values $K_n^m$ by an increment $\Delta K_2$ and if $K_1$ is detected, a step 504 is executed to decrease one of the $K_2$ values $K_n^m$ by a decrement $\Delta K_2$. More specifically, all of the second correction data $K_2$ are set at 1 prior to shipment of the vehicle and each of which is successively increased by $\Delta K_2$ as the step 503 is repeated until the $K_1$ value becomes equal to unity, or successively decreased by the same amount as the step 504 is repeatedly executed until the $K_1$ value becomes greater than unity. The updated $K_2$ value is stored in a storage location of the RAM 107 which is specified by address data represented by the intake air flow data Q and the throttle-closed-or-open status data I. Therefore, as the program sequence of the invention is repeatedly performed under varying operating parameters of the engine 1, the second correction value $K_2$ will be stored in a map format as shown in FIG. 6. In a practical embodiment, the second correction data $K_2$ are stored in 31 different storage locations according to different values of intake air flow Q in a first row which corresponds to throttle closed condition and in a second row which corresponds to throttle open conditions. In general terms, the $K_2$ data are represented by $K_n^m$, where m is 1 or 2 representing respectively the throttle closed and open conditions, and n ranges from 1 to 31 representing proportionally the air intake flows or engine loads.

After completion of the step 1007, the program returns to the step 1004 to repeat the above process.

In response to receipt of an interrupt command signal from the interrupt control unit 102, the CPU 100 interrupts the main routine tasks no matter at which point of the main routine the CPU is executing and proceeds with an interrupt routine in which it determines the fuel injection time. This interrupt routine starts off with a step 1010 (FIG. 3) which begins at any point of the main routine as indicated by broken lines. At step 1011 the CPU 100 reads in the engine speed data N from the speed counter 101 and proceeds to a step 1012 to read in the detected intake air flow data Q from the analog input port 104. At step 1013, the throttle-closed-or-open status data I is read into the CPU 100 and at step 1014, all the read-in data are stored in the RAM 107. At step 1015, a basic fuel injection time t is derived by an arithmetic division $t=F(Q/N)$, where F is a constant. In a subsequent step 1016, the temperature correction data $K_0$ and the first correction data $K_1$ are retrieved from the respective storage locations of the RAM 107. At the same time, one of the second correction data $K_2$ is retrieved from a storage location by an address data derived from the air quantity data Q and throttle-closed-or-open status data I stored at step 1014. The basic fuel injection time datum t is corrected in accordance with a formula $T=t\cdot K_0\cdot K_1\cdot K_2$. The corrected fuel injection time datum T is loaded into the counter 109 at step 1017 to permit it to generate a fuel injection pulse for the injectors 5. The step 1017 is followed by a step 1018 to return the program control to the point of the main routine where the executation was interrupted.

The ratio of air and fuel supplied to the engine 1 is thus feedback controlled in response to the output signal from the exhaust gas sensor 14. The second correction data $K_2$ stored in a map are automatically updated to appropriate values in response to the aging characteristics of the engine or other sensors and in response to varying environmental conditions which affect the engine operating performance. When the engine load is rapidly changed in response to a manual command (acceleration or deceleration), one of the previously updated correction data $K_2$ is selected in response to the rapidly varied air intake flow Q. Thus the air-fuel mixture ratio is varied rapidly in response to a load variation to permit the engine to deliver corresponding output power in rapid response to a manual command. Since the $K_2$ value is automatically corrected as described above, the air fuel mixture is constantly controlled to meet varying engine operating parameters which affect the engine performance.

Figures 8A, 8B:
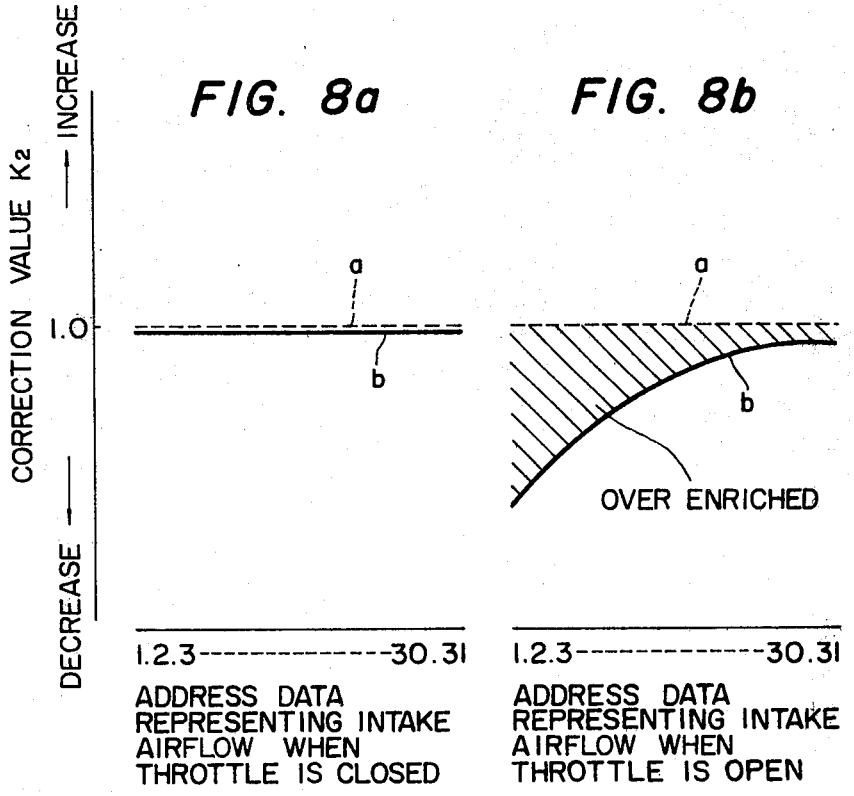
FIGS. 8*a* and 8*b* are graphic illustations of the characteristics of second correction data under different engine conditions.

The detail of the step 1002 of FIG. 3 will now be described with reference to FIGS. 7 and 8. FIG. 7 is an illustration of a conventional arrangement of the fuel vapor supply system which shows that fuel evaporated in the fuel tank 30 is led through a duct 31 and absorbed in the portion of canister 40 where activated charcoal is provided. Outside air is introduced through an opening 43 to purge the absorbed fuel vapor through a pipe 41 to a port 42 of the intake pipe 3 at a point slightly upstream of the throttle valve 4 when the latter is partially open. FIGS. 8*a* and 8*b* are graphic illustrations of the relationships between the second correction value $K_2$ and the air intake flow Q for different engine operating conditions when the throttle is closed or open, respectively. The second correction data $K_2$ which are used when the throttle is substantially closed is maintained at 1.0 regardless of the intake air flow as indicated by a straight line a in FIG. 8*a*. On the other hand, when the throttle is open, the $K_2$ value is increased nonlinearly as a function of air intake flow as indicated by a curve b in FIG. 8*b* to compensate for over-enrichment (as indicated by the hatched-area, FIG. 8*b*) which arises due to the fact that a high vacuum in the intake pipe 3 causes an increase in fuel vapor supplied to the engine.

Since the second correction data $K_2$ are stored in the non-volatile memory 107 and since their correction values in the map are appropriate for the engine operating in the previous cycle time of the microcomputer, the data stored in the memory 107 may not be appropriate due to the different rates of fuel evaporation just described. In order to compensate for errors arising from differing fuel evaporation effect, the second correction data $K_2$ are reset to appropriate values at the step 1002 at the start of the engine if the following formula is satisfied:

$$[(K_A+K_B)/2]-K_C>X$$

where, $K_A$ is an average value of $K_1^1$ to $K_{31}^1$, $K_B$ is an average value of $K_{30}^2$ and $K_{31}^2$ for large intake air flow, $K_C$ is an average value of $K_1^2$ and $K_2^2$ for small intake air flow and X is a constant determined by the engine driving performance and the concentration of harmful exhaust gases (normally, a value of 0.04 to 0.06 is used for X).

Thus, in the step 1002, $K_1^1$ to $K_{31}^1$, $K_1^2$, $K_2^2$, $K_{30}^2$ and $K_{31}^2$ are read out of the RAM 107 and arithmetic operations are executed to derive $K_A$, $K_B$ and $K_C$ which are substituted into the above formula to determine whether the reset condition is met. The appropriate reset values for the second correction data $K_2$ are typically "1". However, the reset value may also be selected by interpolating the $K_A$ and $K_B$ values.

When the exhaust gas sensor 14 remains inactive due to low sensor environment temperatures, the first mixture correction datum $K_1$ is reset to "1" at step 406, FIG. 4. Therefore, the program control takes a decision route "$K_1=1$" from the step 502, FIG. 5, so that the second mixture correction data $K_2$ remain unchanged to make the system operate in the open loop mode. Since the $K_2$ values are checked at the step 1002, the air-fuel ratio is controlled at an appropriate value even though the gas sensor remains inactive.

As a result of the air-fuel ratio being controlled in the closed loop or self-learning mode, the second corrective data $K_2$ are varied so that they cause the first corrective datum $K_1$ to approach the preselected value, i.e. "1".

What is claimed is:

1. A method for supplying a mixture of air and fuel to an internal combustion engine at a variable air-fuel ratio in response to a concentration signal derived from an exhaust gas sensor located in an exhaust system of the engine, said signal representing the concentration of predetermined constituents of the exhaust emissions, comprising the steps of:

(a) generating a first corrective datum representing an amount of said air-fuel ratio to be corrected toward an optimum value and varying as a function of time in a direction depending on said concentration signal;

(b) generating second correction data representing an amount of said air-fuel ratio to be additionally corrected toward said optimum value and varying in a direction depending on the value of said first corrective datum;

(c) detecting the air flow supplied to said engine;

(d) storing said second correction data in a selected one of first storage locations corresponding to said detected air flow when the throttle of said engine is closed, or storing said second corrective data in a selected one of second storage locations corresponding to said detected air flow when said throttle is open;

(e) retrieving a said stored datum from said first storage locations in response to said detected air flow when said throttle is closed, or retrieving a said stored datum from said second storage locations in response to said detected air flow when said throttle is open;

(f) detecting whether the stored second corrective data are greater than a first predetermined value; and (g) resetting said stored second corrective data to a second predetermined value if said stored second data are detected as being greater than said first predetermined value in the step (f).

2. A method as claimed in claim 1, wherein the step (e) comprises:

retrieving data from predetermined ones of said first and second storage locations;

deriving an average value of the retrieved data; and substituting said average value into a formula to reset all of said data stored in said first and second storage locations to said appropriate value when said formula satisfies a predetermined condition.

3. A method as claimed in claim 1, wherein the step (a) comprises gradually increasing the value of said first corrective datum when said concentration signal is at a first voltage level or gradually decreasing the value of said first corrective datum when said concentration signal is at a second voltage level, wherein the step (b) comprises gradually increasing said second corrective data when said first corrective datum is greater than a preselected value or gradually decreasing said second corrective data when said first corrective datum is smaller than said preselected value so that said first corrective datum approaches a desired control value.

4. A method as claimed in claim 1, wherein the step (d) comprises correcting said air-fuel ratio as a function of the product of said first and second corrective data.

5. A method as claimed in claims 1, 2, 3 or 4, further comprising detecting when said exhaust gas sensor remains inactive, disabling the step (a) to cause said first correction datum to be reset to a first constant value, and disabling the step (b) to cause the second correction data to remain at a second constant value.

6. A method for supplying a mixture of air and fuel to an internal combustion engine at a variable air-fuel ratio in response to a concentration signal derived from an exhaust gas sensor located in an exhaust system of the engine, said signal representing the concentration of predetermined constituents of the exhaust emissions, comprising the steps of:

(a) generating a first corrective datum representing an amount of said air-fuel ratio to be corrected toward an optimum value and varying as a function of time in a direction depending on said concentration signal;

(b) generating second corrective data representing an amount of said air-fuel ratio to be additionally corrected toward said optimum value and varying in a direction depending on the value of said first corrective datum, said second corrective data comprise a first set of data corresponding to the throttle valve of said engine being closed and a second set of data corresponding to said throttle valve being open, each datum of said first and second data sets corresponding to difference values of an air flow supplied to said engine (c) storing said second corrective data in a non-volatile memory;

(d) correcting said air-fuel ratio as a function of said first corrective datum and as a function of said stored second corrective data;

(e) detecting whether the stored second corrective data are greater than a first predetermined value; and (f) resetting said stored second corrective data to a second predetermined value if the following formula is satisfied:

$$\{(K_A+K_B)/2\}-K_C>X$$

where $K_A$ is an average value of all the data of said first set, $K_B$ is an average value of the partial data of said second set which correspond to the air flow having a large value, $K_C$ is an average value of the partial data of said second set which correspond to said air flow having a small value, and X is a constant.

7. A method for supplying a mixture of air and fuel to an internal combustion engine at a variable air-fuel ratio in response to a signal derived from an exhaust gas sensor located in an exhaust system of the engine, said signal representing in binary level the concentration of predetermined constituents of the exhaust emissions, said air-fuel ratio being further controlled in response to a signal derived from an air flow detector for detecting the amount of air inducted into said engine and further in response to a signal derived from a throttle position detector, comprising the steps of:

(a) establishing a first corrective setting;

(b) adding an increment to said first setting when said concentration representing signal is at a first binary level or subtracting a decrement from said first setting when said concentration representing signal is at a second binary level;

(c) establishing second corrective settings in storage locations arranged in a matrix of rows and columns, said rows corresponding to different throttle positions detected by said throttle position detector and said columns corresponding to different values of quantity of air supplied to said engine;

(d) adding an increment to a said second setting corresponding to the detected intake air quantity and to the detected throttle position when said varied first corrective setting is greater than said preselected value or subtracting a decrement from a said second corrective setting corresponding to the detected intake air quantity and to the detected throttle position when said varied first corrective setting is smaller than said preselected value;

(e) selecting a said varied second setting corresponding to the detected intake air flow;

(f) correcting said air fuel ratio as a function of said varied first setting and as a function of said selected second setting;

(g) repeating the steps (a) to (f);

(h) detecting when an average value of said second settings in said rows corresponds to a predetermined value representing an engine idle condition at the time said engine started; and (i) resetting all of said second settings to appropriate values in response to the step (h).

8. A method as claimed in claim 7, further comprising the steps of:

detecting when said exhaust gas sensor remains in an inactive state;

resetting said first corrective setting of the step (a) to a constant value when said inactive state is detected;

disabling the step (b); and disabling the step (d) as long as said first corrective setting remains at said constant value.

9. A closed loop control system for supplying a mixture of air and fuel to an internal combustion engine at a variable air-fuel ratio in response to a concentration signal derived from an exhaust gas sensor located in an exhaust system of the engine to represent in binary level the concentration of predetermined constituents of the exhaust emissions, means for detecting when said engine starts operating, means for detecting the quantity of air supplied to said engine and means for detecting whether the throttle valve of said engine is closed or open, comprising:

means for generating a first corrective datum representing an amount of said air-fuel ratio to be corrected toward an optimum value and varying as a function of time in a direction depending on the binary level of said concentration signal;

means for generating second correction data representing an amount of said air-fuel ratio to be additionally corrected toward said optimum value and varying in a direction depending on the value of said first corrective datum;

a non-volatile memory having an array of first storage locations and an array of second storage locations;

means for storing said second corrective data in said first storage locations corresponding to said detected air flow when said throttle valve is detected as being closed and means for storing said second corrective data in said second storage locations corresponding to said detected air flow when said throttle valve is detected as being open;

means for retrieving a said stored datum from said first storage locations in response to said detected air flow when said throttle valve is detected as being closed and retrieving a said stored datum from said second storage locations in response to said detected air flow when said throttle valve is detected as being open;

means for multiplying the retrieved data by said first corrective datum to correct said mixture ratio as a function of the multiplied data; and means operative in response to said engine start detecting means for resetting said stored data to an appropriate value if the stored data are greater than a predetermined value.

10. A closed loop control system as claimed in claim 9, wherein said resetting means comprises means for retrieving data from predetermined ones of said first and second storage locations, means for deriving an average value of the retrieved data, and means for substituting said average value into a formula to reset all of said data stored in said first and second storage locations to said appropriate value when said formula satisfies a predetermined condition.

11. A closed loop control system as claimed in claim 9, wherein said first corrective datum generating means comprises means for gradually increasing a first corrective setting which represents said air-fuel ratio to be corrected when said concentration signal is at a first binary level or gradually decreasing said first corrective setting when said concentration signal is at a second binary level, and wherein said second corrective data generating means comprises means for gradually increasing a second corrective setting which represents said air-fuel ratio to be further corrected when said first corrective setting is greater than a preselected value or gradually decreasing said second corrective setting when said first corrective setting is smaller than said preselected value.

12. A closed loop control system as claimed in claim 9, wherein said correcting means comprises means for correcting said air-fuel ratio as a function of the product of said first and second corrective data.

13. A closed loop control system as claimed in claim 9, 10, 11 or 12 further comprising means for detecting when said exhaust gas sensor remains in an inactive state, means for holding said first correction datum at a first constant value when said inactive state is detected; and means for holding said second correction data at a second constant value as long as said first correction data remains at said first constant value.

14. A closed loop control system as claimed in claim 9, wherein said second corrective data comprise a first set of data corresponding to the throttle valve of said engine being closed and a second set of data corresponding to said throttle valve being open, each datum of said first and second data sets corresponding to different values of an air flow supplied to said engine, wherein said resetting means comprises means for resetting said stored second corrective data to an appropriate value if the following formula is satisfied:

$$[(K_A+K_B)/2]-K_C>X$$

where $K_A$ is an average value of all the data of said first set, $K_B$ is an average value of the partial data of said second set which correspond to the air flow having a large value, $K_C$ is an average value of the partial data of said second set which correspond to said air flow having a small value, and X is a constant.

15. A closed loop control system for supplying air and fuel to an internal combustion engine at a variable air-fuel ratio in response to a concentration signal derived from an exhaust gas sensor located in an exhaust system of the engine to represent the concentration of predetermined constituents of the exhaust emissions, comprising:

means for detecting the quantity of air inducted to said engine;

engine condition detecting means for detecting whether said engine is idling or operating under load; and a microcomputer which is programmed to perform the steps of:

(a) establishing a first corrective setting;

(b) adding an increment to said first corrective setting when the concentration signal is at a first voltage level or subtracting a decrement from said first corrective setting when the concentration signal is at a second voltage level;

(c) establishing second corrective settings in a matrix of rows and columns, said rows corresponding to different conditions of said engine and said columns corresponding to different values of the quantity of said inducted air;

(d) adding an increment to a said second corrective setting corresponding to the detected quantity of intake air and to the detected engine condition when said varied first corrective setting is greater than a preselected value or subtracting a decrement from a said second corective setting corresponding to the detected quantity of the inducted air and to the detected engine condition when said varied first corrective setting is smaller than said preselected value;

(e) selecting a said varied second corrective setting corresponding to the detected quantity of intake air;

(f) correcting said air fuel ratio as a function of said varied first corrective setting and as a function of said selected second corrective setting;

(g) repeating the steps (a) to (f);

(h) detecting when an average value of said second corrective setting corresponds to a predetermined condition which represents an engine idle condition at the time said engine is started; and (i) resetting all of said second corrective settings to appropriate values in response to the step (h).

16. A closed loop control system as claimed in claim 15, wherein said microcomputer is further programmed to perform the steps of:

detecting when said exhaust gas sensor is in an inactive state;

resetting first corrective setting to a constant value when said inactive state is detected;

disabling the step (b); and disabling the step (d) as long as said first corrective setting remains at said constant value.

* * * * *